US009283465B1

(12) United States Patent
Moragne

(10) Patent No.: US 9,283,465 B1
(45) Date of Patent: Mar. 15, 2016

(54) GOLF PRACTICE AID TO ENHANCE SHOOTING DISTANCE AND ACCURACY

(71) Applicant: David Moragne, Makawao, HI (US)

(72) Inventor: David Moragne, Makawao, HI (US)

( * ) Notice: Subject to any disclaimer, the term of this patent is extended or adjusted under 35 U.S.C. 154(b) by 0 days.

(21) Appl. No.: 14/614,306

(22) Filed: Feb. 4, 2015

(51) Int. Cl.
*A63B 69/36* (2006.01)

(52) U.S. Cl.
CPC ..... *A63B 69/3667* (2013.01)

(58) Field of Classification Search
USPC ..... 473/257, 258, 259, 260, 261, 264, 265, 473/273
See application file for complete search history.

(56) References Cited

U.S. PATENT DOCUMENTS 3,357,705 A 12/1967 Blanchard
3,813,737 A * 6/1974 Larsen ..... 24/66.9
4,411,431 A 10/1983 Judice
5,595,546 A * 1/1997 Masters ..... 473/280
5,896,756 A * 4/1999 Watkins ..... 63/3
5,993,326 A * 11/1999 Hitchman et al. ..... 473/257
6,202,443 B1 * 3/2001 Grosser-Samuels ..... 63/3
6,241,572 B1 * 6/2001 Braginsky ..... 446/85
2003/0162602 A1 * 8/2003 Tai et al. ..... 473/265
2004/0167424 A1 * 8/2004 Mulcaire-Jones ..... 600/551
2013/0303298 A1 * 11/2013 Riedl ..... 473/257

* cited by examiner

*Primary Examiner* — Nini Legesse
(74) *Attorney, Agent, or Firm* — John P. Wooldridge; Mark H. Plager

(57) ABSTRACT

A golf practice aid enhances shooting distance and accuracy by enabling a user to properly align a ball relative to a stance of the user. This improves contact between the ball and a club during a golf swing. The golf practice aid includes a rope with a first end and a second end, a fastening component affixed to the second end of the rope and slidably connected to an intermediate portion of the rope to create a loop portion in the rope, and a plurality of marker components slidably mounted to the rope. The rope is disposed on a ground surface and the plurality of marker components are slidably adjusted based on the stance of the user to create a visual tool that aids the user to properly align the ball on the ground surface for the golf swing.

11 Claims, 4 Drawing Sheets

GOLF PRACTICE AID TO ENHANCE SHOOTING DISTANCE AND ACCURACY

BACKGROUND

The embodiments herein relate generally to golf practice aids.

In order to improve performance on a course, golfers need to practice their swing form and technique for all clubs including woods, irons, wedges and putters. Golfers typically align a golf ball on the ground with different parts of a stance depending on the type of club used. For example, a golf ball is placed towards the front of the golfer's stance when using woods, the middle of the golfer's stance when using mid-irons, and the rear of the golfer's stance when using wedges. To improve contact between the club head and the ball, golfers are taught to take a divot on most swings, except when using a putter or wood such as a driver. The divot location in the ground should ideally be slightly in front of the ball along the path of a golf swing. Golfers can greatly improve their game by practicing the process of taking a divot and proper ball alignment.

There exist several golf practice devices such as those disclosed in U.S. Pat. Nos. 3,357,705 and 4,411,431, which comprise a pair of spherical members secured together by a connecting member. These devices are intended to be placed on the ground and struck with a golf club. As a result, these devices do not help a golfer to properly align the golf ball on the ground to different parts of his/her stance and analyze the divot location relative to the initial ball placement location after a swing.

As such, there is a need in the industry for a golf practice aid that allows users to properly align a ball relative to their stance and analyze the divot location in the ground after a swing.

SUMMARY

A golf practice aid configured to enhance shooting distance and accuracy by enabling a user to properly align a ball relative to a stance of the user to improve contact between the ball and a club during a golf swing is provided. The golf practice aid comprises a rope comprising a first end and a second end, a fastening component affixed to the second end of the rope and slidably connected to an intermediate portion of the rope to create a loop portion in the rope, wherein the intermediate portion of the rope is slidably adjusted relative to the fastening component to adjust the length of the rope between the first end and the intermediate portion, and a plurality of marker components slidably mounted to the rope, wherein the rope is disposed on a ground surface and the plurality of marker components are slidably adjusted based on the stance of the user to create a visual tool that aids the user to properly align the ball on the ground surface for the golf swing.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
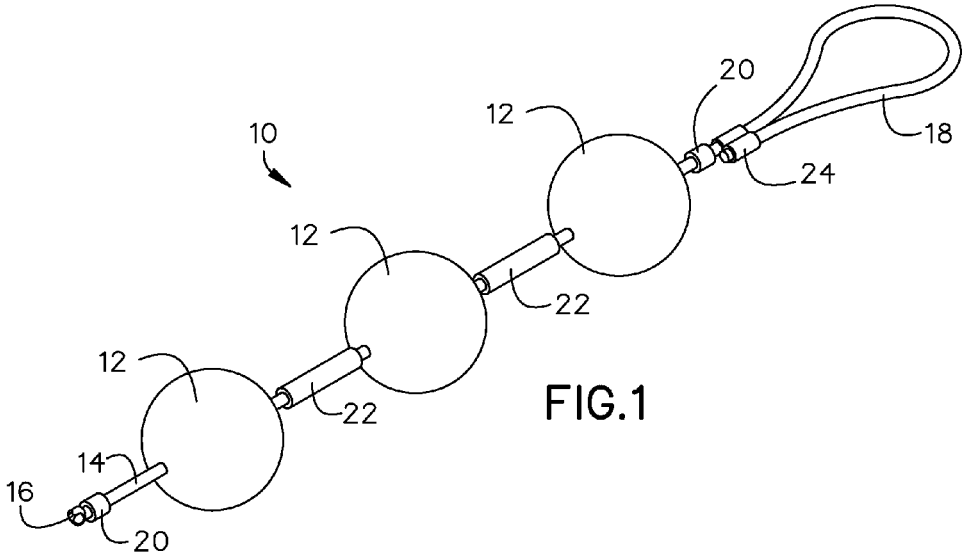
FIG. 1 depicts a front perspective view of certain embodiments of the golf practice aid.
Figure 2:
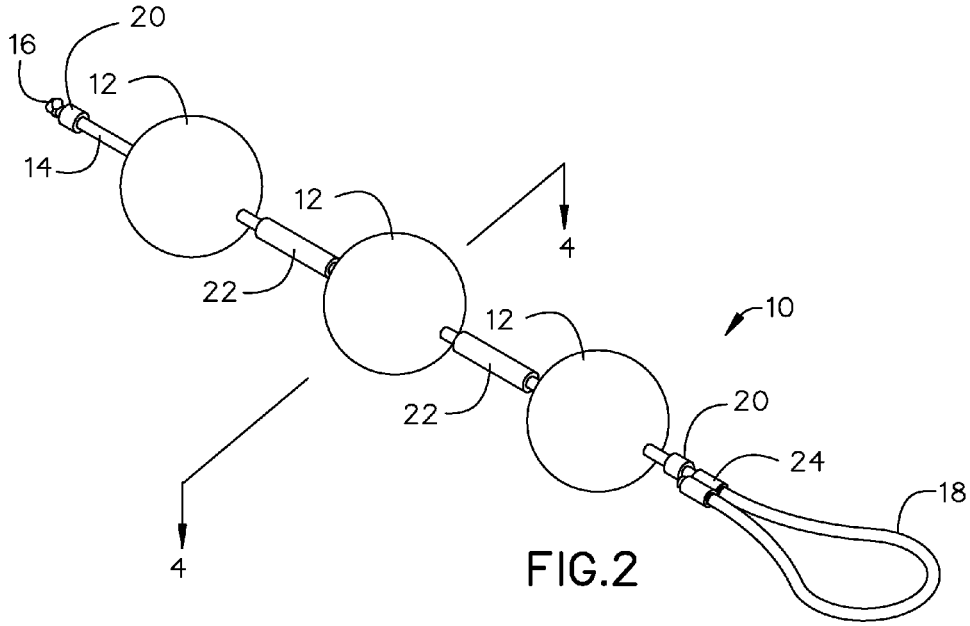
FIG. 2 depicts a rear perspective view of certain embodiments of the golf practice aid.
Figure 3:
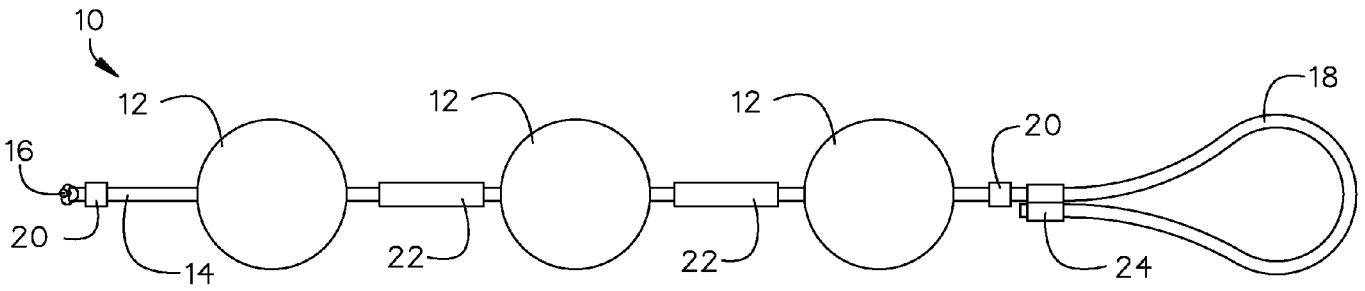
FIG. 3 depicts a top perspective view of certain embodiments of the golf practice aid.
Figure 4:
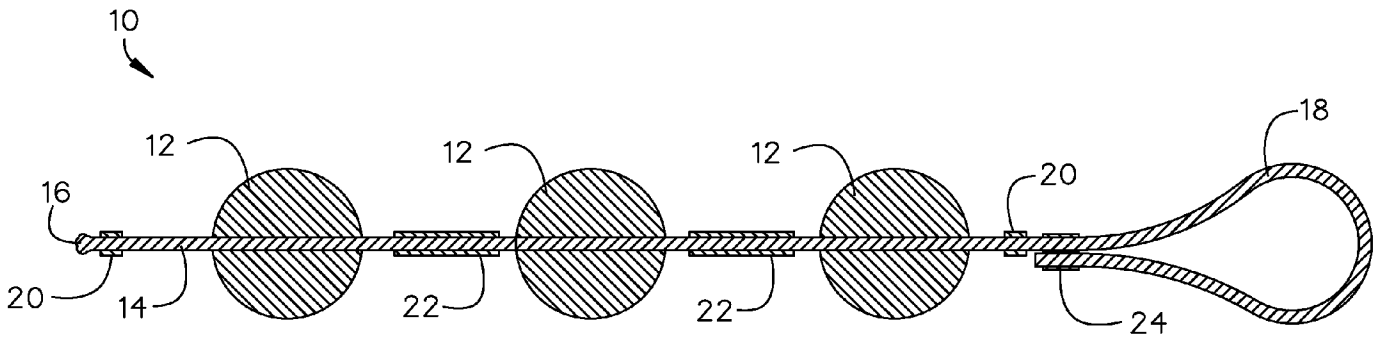
FIG. 4 depicts a section view of certain embodiments of the golf practice aid taken along line 4-4 in FIG. 2.

As depicted in FIGS. 1-4, golf practice aid 10 comprises spherical members 12, rope 14, short spacers 20 and long spacers 22. In a preferred embodiment, rope 14 is made from nylon and comprises an approximate length of 27" and thickness of 5/32". A first end of rope 14 comprises knot 16 and the second end of rope 14 is secured to double barrel sleeve 24. Double barrel sleeve 24 is used to crimp rope 14. This is completed by heating the second end of rope 14 to secure the second end within one opening in double barrel sleeve 24. An intermediate portion of rope 14 is disposed through the second opening of double barrel sleeve 24 to create rope loop 18. The size of rope loop 18 can be adjusted by slidably adjusting the intermediate portion of rope 14 through the second opening of double barrel sleeve 24. This adjustment allows the user to vary the length of rope 14 between knot 16 and double barrel sleeve 24. In a preferred embodiment, golf practice aid 10 is configured such that the distance between knot 16 and double barrel sleeve 24 is approximately 15-16".

Spherical members 12, short spacers 20 and long spacers 22 are slidably mounted to rope 14. Short spacers 20 and long spacers 22 comprise tubular members made from a material such as plastic, aluminum or other metal, and are designed to provide a separation between spherical members 12. A first short spacer 20 is slidably mounted to rope 14 proximate knot 16 and a second short spacer 20 is slidably mounted to rope 14 proximate double barrel sleeve 24. Each spherical member 12 comprises a standard golf ball having an approximate diameter of 1¾" and an aperture to receive rope 14. A first long spacer 22 is slidably mounted to rope 14 between a first spherical member 12 and a second spherical member 12. A second long spacer 22 is slidably mounted to rope 14 between the second spherical member 12 and a third spherical member 12.

Figure 7:
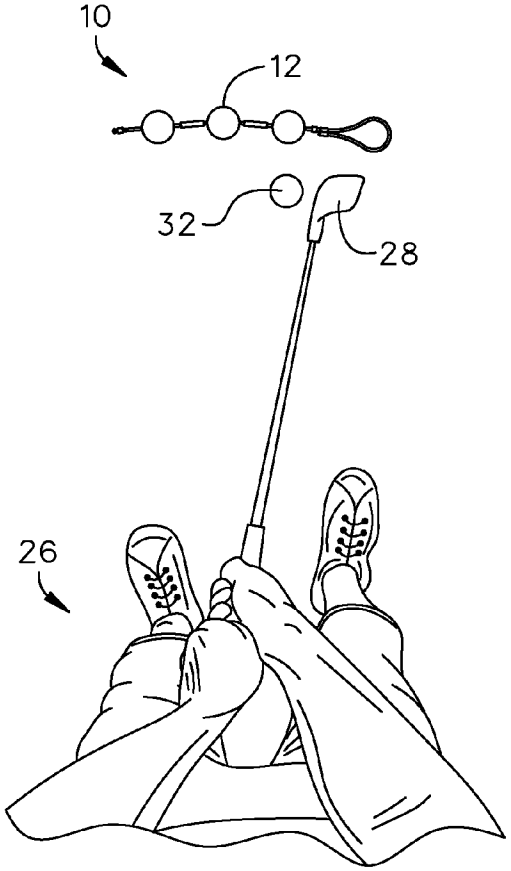
FIG. 7 depicts a top view of certain embodiments of the golf practice aid in use demonstrating the placement of a golf ball towards the rear of the operator's stance.
Figure 6:
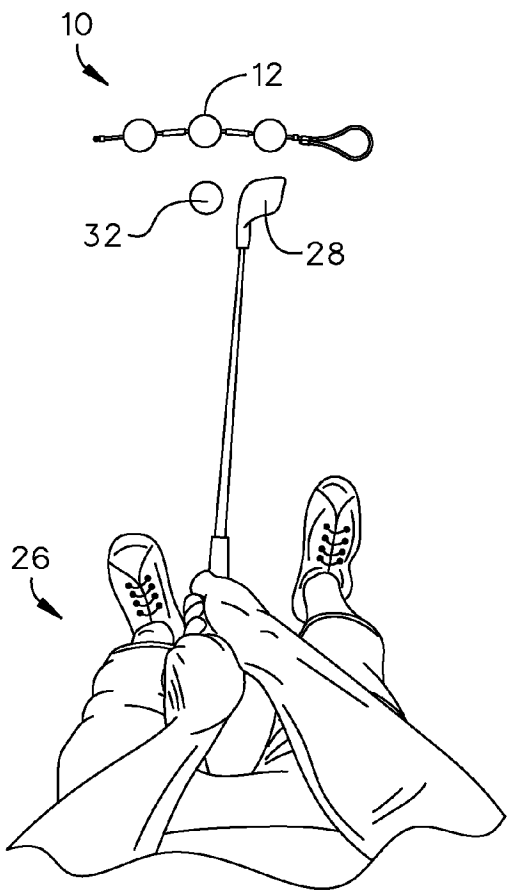
FIG. 6 depicts a top view of certain embodiments of the golf practice aid in use demonstrating the placement of a golf ball towards the middle of the operator's stance.
Figure 5:
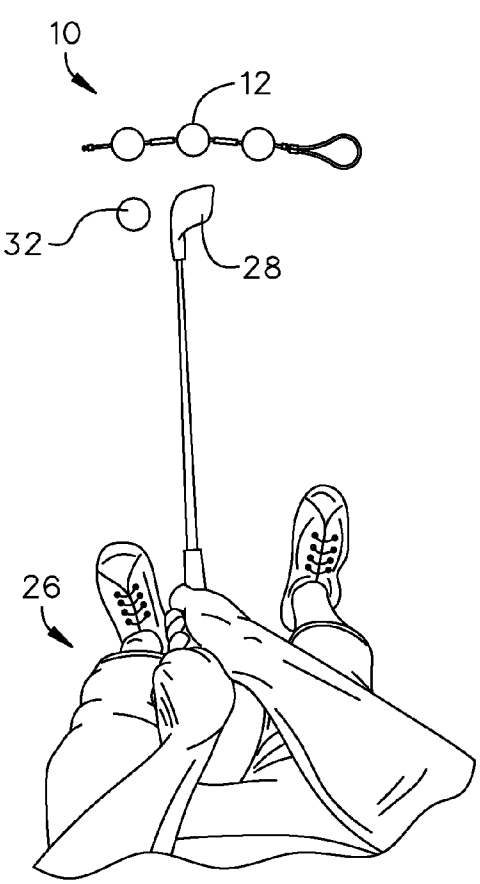
FIG. 5 depicts a top view of certain embodiments of the golf practice aid in use demonstrating the placement of a golf ball towards the front of the operator's stance.

In operation, golf practice aid 10 is configured for use with golf ball 32, golf club 28 and operator 26 as depicted in FIGS. 5-7. The size of rope loop 18 is adjusted to allow first spherical member 12, second spherical member 12 and third spherical member 12 to be adjusted along rope 14 to accommodate a narrow stance or a wide stance of operator 26. This adjustment may vary depending on the skill level of the golfer, swing style and age of the golfer. More specifically, golf practice aid 10 is configured and placed on the ground in front of operator 26 such that the first spherical member 12 is aligned with the front of the operator's stance, the second spherical member 12 is aligned with the middle of the operator's stance, and the third spherical member 12 is aligned with the rear of the operator's stance.

Golf practice aid 10 enables operator 26 to practice shooting golf ball 32 and taking divots from the ground. Prior to a shot, golf ball 32 may be placed on the ground and aligned with any one of spherical members 12. After shooting golf ball 32 with golf club 28, operator 26 can analyze the shot by comparing the location of the divot created in the ground by golf club 28 during the swing to the location of the spherical member 12 initially aligned with golf ball 32 prior to the shot.

As depicted in FIG. 5, golf ball 32 is placed on the ground and aligned with the front of the stance and the first spherical member 12. This configuration is ideal when golf club 28 is a wood or long iron. As depicted in FIG. 6, golf ball 32 is placed on the ground and aligned with the middle of the stance and the second spherical member 12. This configuration is ideal when golf club 28 is a mid iron. As depicted in FIG. 7, golf ball 32 is placed on the ground and aligned with the rear of the stance and the third spherical member 12. This configuration is ideal when golf club 28 is a wedge for use on chip shots. The proper swing technique to enhance contact between the ball and club would cause golf club 28 to create a divot in the ground at the location of golf ball 32 when initially placed on the ground or slightly in front along the path of the swing. After shooting golf ball 32, operator 26 can analyze the shot by comparing the divot location in the ground relative to the corresponding spherical member 12 that was aligned with golf ball 32 prior to the shot. It shall be appreciated that golf practice aid 10 enables a golfer to practice ball alignment and swing technique to enhance contact between a golf ball and a club head, which improves shooting distance and accuracy.

Figure 8:
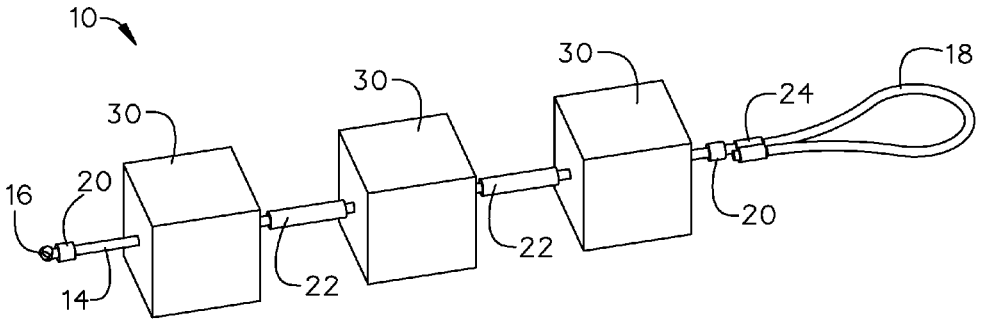
FIG. 8 depicts a perspective view of an alternative embodiment of the golf practice aid.

In an alternative embodiment, spherical members 12 may be replaced by blocks 30 as depicted in FIG. 8. This may be advantageous when golf practice aid 10 is used on a course location with a slope. This minimizes the chance blocks 30 roll or slide on the grass accidentally. Blocks 30 may be made from any materials known in the field such as wood, ceramic, plastic, or the like. It shall be appreciated that alternative shaped components may also be used with golf practice aid 10 instead.

It shall be appreciated that the components of golf practice aid 10 described in several embodiments herein may comprise any alternative known materials in the field and be of any color, size and/or dimensions. It shall be appreciated that the components of golf practice aid 10 described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A golf practice aid, comprising:

a rope comprising a first end and a second end;

a plurality of golf balls slidably mounted onto the rope, wherein the plurality of golf balls comprises a first golf ball, a second golf ball and a third golf ball;

a first spacer slidably mounted onto the rope and positioned between the first end and the first golf ball;

a second spacer slidably mounted onto the rope and positioned between the first golf ball and the second golf ball;

a third spacer slidably mounted onto the rope and positioned between the second golf hall and the third golf ball; and a fourth spacer slidably mounted onto the rope and positioned between the third golf ball and the second end.

2. The golf practice aid of claim 1, further comprising a fastening component affixed relatively near to the second end of the rope and slidably connected to an intermediate portion of the rope to create a loop portion in the rope, wherein the intermediate portion of the rope is slidably adjustable relative to the fastening component to adjust the length of the rope between the first end and the intermediate portion.

3. The golf practice aid of claim 2, wherein the fastening component is a double barrel sleeve.

4. The golf practice aid of claim 1, wherein the first end of the rope comprises a knot.

5. An apparatus, comprising:

a line having a first end and a second end;

a series of elements slidably mounted onto said line, wherein said series of elements comprises, in the following order, a first spacer, a first golf ball, a second spacer, a second golf ball, a third spacer, a third golf ball and a fourth spacer, wherein said first spacer is located between said first end and said first golf ball and wherein said fourth spacer is located between said third golf ball and said second end;

means for retaining said first spacer on said line; and an adjustable termination between said fourth spacer and said second end, wherein said adjustable termination can be moved to change the length of said line between said first end and said adjustable termination.

6. The apparatus of claim 5, wherein said line comprises rope.

7. The apparatus of claim 5, wherein said first spacer, said second spacer, said third spacer and said fourth spacer are tubular.

8. The apparatus of claim 5, wherein said first spacer and said forth spacer are about the same length, wherein said second spacer and said third spacer are about the same length, wherein both said first spacer and said fourth spacer are shorter than said second spacer and said third spacer.

9. The apparatus of claim 5, wherein said means for retaining said first spacer on said line comprises a knot in said line.

10. The apparatus of claim 5, wherein said adjustable termination comprises a fastening component affixed between said fourth spacer and said second end, wherein said fastening component is slidably connected to an intermediate portion of said line to create a loop portion in said line.

11. The apparatus of claim 10, wherein said fastening component is a double barrel sleeve.

* * * * *